US006147589A

United States Patent [19]

Ohmura

[11] Patent Number: 6,147,589

[45] Date of Patent: Nov. 14, 2000

[54] NEGATIVE TEMPERATURE COEFFICIENT THERMISTOR

[75] Inventor: Kingo Ohmura, Kusatsu, Japan

[73] Assignee: Murata Manufacturing Co., Ltd., Nagaokakyo, Japan

[21] Appl. No.: 09/511,708

[22] Filed: Feb. 23, 2000

[30] Foreign Application Priority Data

Mar. 11, 1999 [JP] Japan ..... 11-1164904

[51] Int. Cl.[7] ..... H01C 7/13

[52] U.S. Cl. ..... 338/22 R; 338/22; 338/50

[58] Field of Search ..... 338/22 R, 22 SD

[56] References Cited

U.S. PATENT DOCUMENTS 5,504,371 4/1996 Niimi et al. ..... 257/703

5,703,000 12/1997 Nakayama et al. ..... 501/152

*Primary Examiner*—Karl D. Easthom

*Attorney, Agent, or Firm*—Burns, Doane, Swecker & Mathis, LLP

[57] ABSTRACT

It is an object of the present invention to provide an improved negative temperature coefficient thermistor capable of increasing an adhesion strength between a negative temperature coefficient thermistor element consisting of $LaCoO_3$ rare earth transition element oxide on one hand and electrodes on the other, thereby improving a reliability of the thermistor product. The negative temperature coefficient thermistor of the present invention is obtained by forming electrodes on the surface of a negative temperature coefficient thermistor element consisting of $LaCoO_3$ rear earth transition element oxide. Such electrodes are formed by adding one or more kinds of oxide powders of Ni, Cr, Mn and Fe in a metal powder, with the content of the oxide powders in the metal powder being 1.0 wt % or less (however, not including 0 wt %).

14 Claims, 1 Drawing Sheet

NEGATIVE TEMPERATURE COEFFICIENT THERMISTOR

BACKGROUND OF THE INVENTION

1. Field of the Invention

The present invention relates to a negative temperature coefficient thermistor consisting of $LaCoO_3$ rare earth transition element oxide, capable of inhibiting a rush current.

2. Description of the Related Art

The $LaCoO_3$ rare earth transition element oxide has a larger B constant than that of a conventional manganese spinel negative temperature coefficient thermistor material, and is capable of further reducing a resistance value of a thermistor element at a high temperature. Therefore, when an electric current is applied, it is possible to inhibit a self heat generation of a negative temperature coefficient thermistor element, thereby increasing a rated current value. For this reason, $LaCoO_3$ rare earth transition element oxide is suitable for use as a material in forming a negative temperature coefficient thermistor element capable of inhibiting a rush current.

However, when external electrodes are to be formed on a negative temperature coefficient thermistor element consisting of a $LaCoO_3$ rare earth transition element oxide, if Ag or Ag—Pd paste for forming a sort of thick film electrode is used which contains a kind of glass frit consisting of usual $SiO_2$, PbO, $Bi_2O_3$, an interface between a negative temperature coefficient thermistor element and the external electrodes will become non-ohmic, hence making the negative temperature coefficient thermistor element to have only an unstable resistance value. For this reason, a negative temperature coefficient thermistor element consisting of $LaCoO_3$ rare earth transition element oxide is formed on the outer surfaces thereof with external electrodes which are obtained by using a thick film electrode formation paste not containing the above glass frit.

However, since the above negative temperature coefficient thermistor containing as its main component the above $LaCoO_3$ rare earth transition element oxide, is provided with external electrodes which are formed by a fritless paste, there is only a lower adhesion strength between the negative temperature coefficient thermistor element and the external electrodes than that of a thick film electrode containing a common glass frit. When one tries to increase the adhesion strength between the negative temperature coefficient thermistor element and the external electrodes, it will not be sufficient if a sintering treatment is carried out at a temperature of 600 to 850° C. for one hour (just like a process in which a common thick film electrode is formed). Instead, such a sintering treatment is needed to be conducted at a temperature of 900 to 1000° C. for five hours. Hence, as a result, since a relatively long time is required in forming the external electrodes, there had been a problem that the external electrodes have to be formed with a high cost.

Moreover, there have been existing another problem which may be concluded as follows. Namely, if a negative temperature coefficient thermistor having formed thereon the external electrodes is attached to a circuit board, or if a lead wire is soldered on to a negative temperature coefficient thermistor having formed thereon the external electrodes, it is allowed to obtain a certain negative temperature coefficient thermistor product. If such a negative temperature coefficient thermistor product is continuously used under a temperature of 100° C. or higher, a solder component such as Sn will diffuse on to the external electrodes, so that an element Ag forming the external electrodes will be corroded due to the solder. As a result, the external electrodes will have only a low strength, and the resistance value of the negative temperature coefficient thermistor will become high.

SUMMARY OF THE INVENTION

It is an object of the present invention to provide an improved negative temperature coefficient thermistor capable of increasing an adhesion strength between a negative temperature coefficient thermistor element consisting of $LaCoO_3$ rare earth transition element oxide on one hand and its external electrodes on the other, thereby improving a reliability of the thermistor product.

A first negative temperature coefficient thermistor according to the present invention is characterized in that said thermistor is obtained by forming external electrodes on the surface of a negative temperature coefficient thermistor element. In particular, the negative temperature coefficient thermistor element includes $LaCoO_3$ rare earth transition element oxide, while the external electrodes include an electrically conductive material formed by adding one or more kinds of oxide powders of Ni, Cr, Mn and Fe in a metal powder.

A second negative temperature coefficient thermistor according to the present invention is characterized in that said thermistor is obtained by forming external electrodes on the surface of a negative temperature coefficient thermistor element, followed by connecting terminals on to the external electrodes by means of solderring treatment. In particular, the negative temperature coefficient thermistor element includes $LaCoO_3$ rare earth transition element oxide, while the external electrodes include an electrically conductive material formed by adding one or more kinds of oxide powders of Ni, Cr, Mn and Fe in a metal powder.

A third negative temperature coefficient thermistor according to the present invention is characterized in that said thermistor is obtained by forming external electrodes on the surface of a negative temperature coefficient thermistor element, said negative temperature coefficient thermistor element being received into a case under a condition in which the thermistor element is elastically held by terminals. In particular, the negative temperature coefficient thermistor element includes $LaCoO_3$ rare earth transition element oxide, while the external electrodes include an electrically conductive material formed by adding one or more kinds of oxide powders of Ni, Cr, Mn and Fe in a metal powder.

In the above first to third negative temperature coefficient thermistors, the metal powder includes Ag, Ag—Pd, or Ag—Pt.

In the above first to third negative temperature coefficient thermistors, the content of the oxide powders in the metal powder is preferred to be 1.0 wt % or less (however, not including 0 wt %).

In the above second negative temperature coefficient thermistor, its negative temperature coefficient thermistor element is coated with an external decorative resin.

In this way, it is possible to increase an adhesion strength between the negative temperature coefficient thermistor element and its external electrodes.

DESCRIPTION OF THE PREFERRED EMBODIMENTS

Figure 1:
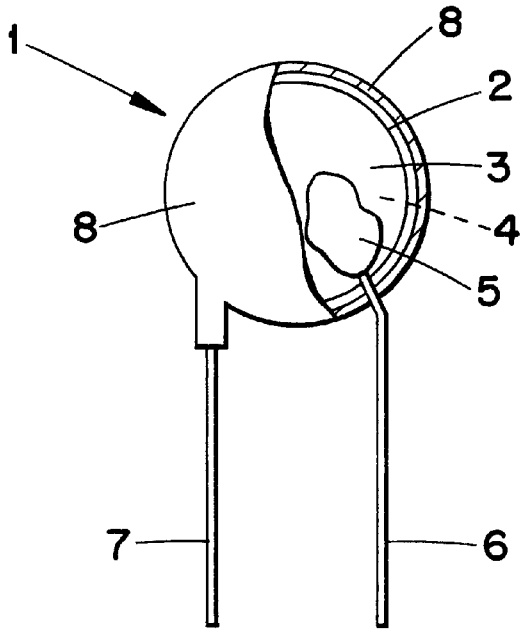
FIG. 1 is a partially cut sectional view schematically indicating a negative temperature coefficient thermistor made according to one embodiment of the present invention.

One embodiment of the present invention will be described in the following with reference to FIG. 1 which schematically indicates a negative temperature coefficient thermistor 1 of a lead type.

The negative temperature coefficient thermistor 1 comprises a negative temperature coefficient thermistor element 2, two main surfaces of the negative temperature coefficient thermistor element 2, external electrodes 3 and 4 formed on the two main surfaces of the thermistor element, lead wires 6 and 7 attached thereon so as to be electrically connected with the external electrodes 3 and 4, a external decorative resin layer 8.

The negative temperature coefficient thermistor element 2 is made of a ceramic material containing $LaCoO_3$ rare earth transition element oxide as its main component, and is formed into a plate-like member, followed by a sintering treatment, thereby obtaining a circular plate-like member having a diameter of 7 mm and a thickness of 1.5 mm.

The external electrodes 3 and 4 may be formed in the following way. Namely, at first, one or more kinds of oxide powders of Ni, Cr, Mn and Fe are mixed in an amount of 0.1 wt % with a sort of metal particles consisting of Ag, Ag—Pd or Ag—Pt, thereby obtaining an intermediate mixture. Then, an appropriate amount of an organic vehicle is added into the mixture, followed by mixing and kneading treatments, thereby obtaining an electrically conductive paste with its viscosity adjusted. Subsequently, the electrically conductive paste is used to coat the two opposite main surfaces of the negative temperature coefficient thermistor element 2, followed by conducting a baking/sticking treatment at a temperature of 900 to 960° C. for one hour.

Further, two lead wires 6 and 7 are attached on to the electrodes 3 and 4 formed on the two opposite main surfaces of the negative temperature coefficient thermistor element 2, with the use of a high temperature solder 5 such as Sn—Ag (having a composition ratio of 96.5:3.5). Finally, an external decorative resin 8 such as a silicon resin is used to coat the outer surfaces of the above material, thereby obtaining a desired negative temperature coefficient thermistor 1.

Then, the obtained negative temperature coefficient thermistor 1 was investigated for its adhesion strength between the negative temperature coefficient thermistor element 2 and the external electrodes 3, 4, also it was investigated for its change in its resistance when being used at a high temperature. Similarly, the two opposite main surfaces of the negative temperature coefficient thermistor element 2 was coated with a fritless thick film electrode paste not containing an oxide powder of any of Ni, Cr, Mn, Fe but consisting of Ag, Ag—Pd or Ag—Pt, followed by a sintering treatment at a temperature of 900 to 1000° C. for 5 hours, thereby obtaining a conventional negative temperature coefficient thermistor formed according to a prior art. Then, the conventional negative temperature coefficient thermistor was measured for its adhesion strength and its resistance change in the same manner as the above.

As a result, it was found that an adhesion strength between the negative temperature coefficient thermistor element 2 and the external electrodes 3, 4 in the present invention has been increased from 19.6 N to 29.4 N per $\phi 3$ mm, as compared with that of a conventional thermistor. The reason for this fact may be explained as follows. Namely, it is allowed to consider that when the external electrodes 3, 4 are being formed through the baking/sticking treatment, there will be a chemical bond between the oxide particles of $LaCoO_3$ rare earth transition element oxides contained in the negative temperature coefficient thermistor element 2 on one hand, and the particles of NiO, $Cr_2O_3$, $Mn_2O_3$, $Fe_2O_3$ contained in the external electrodes 3, 4 on the other. For example, if the particles contained in the external electrodes 3, 4 are NiO, $LaNiO_3$ will occur on an interface between the negative temperature coefficient thermistor element 2 and the external electrodes 3, 4. Further, for example, it is allowed to consider that NiO will penetrate and diffuse into the negative temperature coefficient thermistor element 2, thereby producing a physical bond due to an anchor effect.

A content of the oxide powders containing one or more kinds of the metals Ni, Cr, Mn, Fe, may be adjusted such that it is sure to obtain the same effects as the external electrodes should produce. In particular, in view of a solder wetability, an adhesion strength of the external electrodes, an influence on the resistance value of a negative temperature coefficient thermistor, it is preferred that a content of the oxide powders should be 1.0 wt % or less.

Further, if the negative temperature coefficient thermistor 1 is used continuously at a temperature of 100° C. or higher, it was found that a change in its resistance value with the passing of time had been greatly inhibited as compared with a prior art, for such a change in resistance value has been reduced from 20% to a value which is less than 1%. The reason for this fact may be explained as follows. Namely, the oxide powders of Ni, Cr, Mn and Fe contained in the external electrodes 3 and 4 are effective for preventing Sn contained in a solder from diffusing into the external electrodes 3 and 4, also effective for preventing the corrosion of Ag of the external electrodes 3 and 4 (such corrosion will otherwise be caused due to the solder), thereby preventing a possible decrease in the adhesion strength of the external electrodes.

Figure 2:
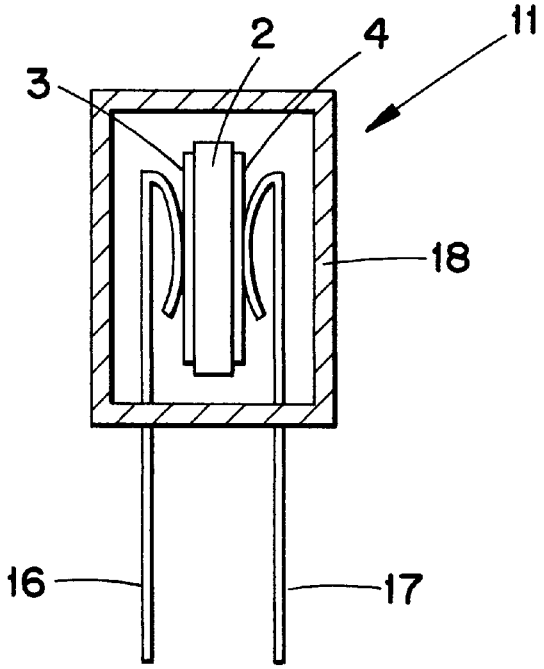
FIG. 2 is a cross sectional view schematically indicating a negative temperature coefficient thermistor made according to another embodiment of the present invention.

FIG. 2 is used to indicate another embodiment of the present invention. As shown in the drawing, the negative temperature coefficient thermistor element 2 is elastically held by two terminals 16 and 17, with two electrodes 3 and 4 on two main surfaces being electrically conductive through the two terminals 16 and 17. In fact, there is formed a case type negative temperature coefficient thermistor 11 in which the negative temperature coefficient thermistor element 2 and the two feeding terminals 16, 17 are all enclosed in a heat resistant case 18.

However, a negative temperature coefficient thermistor of the present invention may be formed not only as electric parts including lead terminals, but also may be formed as chip parts as well.

As discussed in the above, with the use of the present invention, by using electrodes formed by adding one or more kinds of oxide powders of Ni, Cr, Mn and Fe into a metal powder, it is possible to obtain a negative temperature coefficient thermistor having a high adhesion strength between the negative temperature coefficient thermistor element and the external electrodes.

Further, it has been found that even under a high temperature the intensity of the electrodes of the present invention will not become low, thereby inhibiting a change in the resistance value of the negative temperature coefficient thermistor. In this way, it is sure to increase a reliability of the negative temperature coefficient thermistor.

What is claimed is:

1. A negative temperature coefficient thermistor, wherein said thermistor is obtained by forming external electrodes on the surface of a negative temperature coefficient thermistor element;

wherein the negative temperature coefficient thermistor element includes $LaCoO_3$ rare earth transition element oxide, while the external electrodes include an electrically conductive material formed by adding one or more kinds of oxide powders of Ni, Cr, Mn and Fe in a metal powder.

2. The negative temperature coefficient thermistor according to claim 1, wherein said thermistor is obtained by forming said external electrodes on the surface of said negative temperature coefficient thermistor element, followed by connecting terminals on to the external electrodes by means of soldering treatment.

3. The negative temperature coefficient thermistor according to claim 1, wherein said negative temperature coefficient thermistor element is received into a case under a condition in which the thermistor element is elastically held by terminals.

4. The negative temperature coefficient thermistor according to claim 1, wherein the metal powder includes Ag, Ag—Pd, or Ag—Pt.

5. The negative temperature coefficient thermistor according to claim 2, wherein the content of the oxide powders in the metal powder is 1.0 wt % or less (however, not including 0 wt %).

6. The negative temperature coefficient thermistor according to claim 1, wherein said negative temperature coefficient thermistor is a chip part.

7. The negative temperature coefficient thermistor according to claim 2, wherein the metal powder includes Ag, Ag—Pd, or Ag—Pt.

8. The negative temperature coefficient thermistor according to claim 3, wherein the metal powder includes Ag, Ag—Pd, or Ag—Pt.

9. The negative temperature coefficient thermistor according to claim 3, wherein the content of the oxide powders in the metal powder is 1.0 wt % or less (however, not including 0 wt %).

10. The negative temperature coefficient thermistor according to claim 4, wherein the content of the oxide powders in the metal powder is 1.0 wt % or less (however, not including 0 wt %).

11. The negative temperature coefficient thermistor according to claim 2, wherein said negative temperature coefficient thermistor is a chip part.

12. The negative temperature coefficient thermistor according to claim 3, wherein said negative temperature coefficient thermistor is a chip part.

13. The negative temperature coefficient thermistor according to claim 4, wherein said negative temperature coefficient thermistor is a chip part.

14. The negative temperature coefficient thermistor according to claim 5, wherein said negative temperature coefficient thermistor is a chip part.

* * * * *